US006506297B1

(12) United States Patent
Wittenbrink et al.

(10) Patent No.: US 6,506,297 B1
(45) Date of Patent: Jan. 14, 2003

(54) BIODEGRADABLE HIGH PERFORMANCE HYDROCARBON BASE OILS

(75) Inventors: Robert Jay Wittenbrink, Baton Rouge, LA (US); Richard Frank Bauman, Baton Rouge, LA (US); Daniel Francis Ryan, Baton Rouge, LA (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/547,809

(22) Filed: Apr. 11, 2000

Related U.S. Application Data

(60) Division of application No. 09/121,320, filed on Jul. 22, 1998, now Pat. No. 6,096,940, which is a continuation-in-part of application No. 08/569,468, filed on Dec. 8, 1995, now abandoned.

(51) Int. Cl.[7] ..... C10G 71/00; C10M 159/00
(52) U.S. Cl. ..... 208/18; 208/19
(58) Field of Search ..... 208/18, 14, 30, 208/111.35, 112, 28; 585/750

(56) References Cited

U.S. PATENT DOCUMENTS

| | | | | |
|---|---|---|---|---|
| 3,365,390 A | | 1/1968 | Egan et al. | 208/60 |
| 4,082,866 A | * | 4/1978 | Link | 427/294 |
| 4,919,786 A | | 4/1990 | Hamner et al. | 208/27 |
| 5,466,364 A | | 11/1995 | Kaul et al. | 208/307 |
| 5,833,839 A | | 11/1998 | Wittenbrink et al. | 208/112 |

FOREIGN PATENT DOCUMENTS

| | | |
|---|---|---|
| EP | 0225053 | 6/1987 |
| EP | 0321307 | 6/1989 |
| EP | 0323092 | 7/1989 |
| WO | WO9920720 | 4/1999 |

* cited by examiner

*Primary Examiner*—Thuan D. Dang
(74) *Attorney, Agent, or Firm*—Norby L. Foss; Mark D. Marin

(57) ABSTRACT

Discloses novel biodegradable high performance hydrocarbon base oils useful as lubricants in engine oil and industrial compositions, and process for their manufacture. A waxy, or paraffinic feed, particularly a Fischer-Tropsch wax, is reacted over a dual function catalyst to produce hydroisomerization and hydrocracking reactions, at 700° F.+ conversion levels ranging from about 20 to 50 wt. %, preferably about 25–40 wt. %, sufficient to produce a crude fraction, e.g., a $C_5$-1050° F.+ crude fraction, containing 700° F.+ isoparaffins having from about 6.0 to about 7.5 methyl branches per 100 carbon atoms in the molecule. The methyl paraffins containing crude fraction is topped via atmospheric distillation to produce a bottoms fraction having an initial boiling point between about 650° F. and 750° F. which is then solvent dewaxed, and the dewaxed oil is then fractionated under high vacuum to produce biodegradable high performance hydrocarbon base oils.

5 Claims, No Drawings

BIODEGRADABLE HIGH PERFORMANCE HYDROCARBON BASE OILS

CROSS REFERENCE TO RELATED APPLICATIONS

This application is a Divisional under 37 C.F.R. §1.53(b) of U.S. Ser. No. 09/121,320 filed Jul. 22, 1998, U.S. Pat. No. 6,096,940 which was a Continuation-in-Part application of U.S. Ser. No. 08/569,468 filed on Dec. 8, 1995, now abandoned.

1. FIELD OF THE INVENTION

This invention relates to biodegradable high performance hydrocarbon base oils, suitable as engine oil and industrial oil compositions. In particular, it relates to lubricant base oil compositions, and process for making such compositions by the hydroisomerization/hydrocracking of paraffinic waxes, suitably Fischer-Tropsch waxes.

2. BACKGROUND

It is well known that very large amounts of lubricating oils, e.g., engine oils, transmission oils, gear box oils, etc., find their way into the natural environment, accidentally and even deliberately. These oils are capable of causing much environmental harm unless they are acceptably biodegradable. For this reason there is increasing emphasis in this country, and abroad, to develop and employ high performance lubricant base oils which are environmentally friendly, or substantially biodegradable on escape or release into the environment.

Few hydrocarbon base oils are environmentally friendly though their qualities as lubricants may be unchallenged. The literature stresses the superior biodegradability of ester based lubricants, natural and synthetic, over hydrocarbon based products. However there is little or no emphasis on performance. Few references are found relating to the biodegradability of hydrocarbon lubricants. Ethyl Petroleum Additives's EP 468 109A however does disclose the biodegradability of lubricating oils containing at least 10 volume percent of a "biodegradable liquid hydrocarbon of lubricating viscosity formed by oligomerization of a 1-alkene hydrocarbon having 6 to 20 carbon atoms in the molecule and hydrogenation of the resultant oligomer." Apparently hydrogenated oligomers of this type have unexpectedly high biodegradability, particularly those having at least 50 volume percent dimer, trimer and/or tetramer. Ethyl Petroleum Additive's EP 558 835 A1 discloses lubricating oils having similar polyalphaolefin, PAO, components. However, both references point out performance debits for the synthetic and natural ester oils, such as low oxidative stability at high temperatures and poor hydrolytic stability. British Petroleum's FR 2675812 discloses the production of biodegradable PAO hydrocarbons base oils by dewaxing a hydrocracked base oil at low temperatures.

There is a clear need for biodegradable high performance hydrocarbon base oils useful as engine oil and industrial oil, or lubricant compositions which are at least equivalent to the polyalphaolefins in quality, but have the distinct advantage of being more biodegradable.

3. SUMMARY OF THE INVENTION

This invention, which supplies these and other needs, accordingly relates to biodegradable high performance paraffinic lubricant base oils, and process for the production of such compositions by the hydrocracking and hydroisomerization of paraffinic, or waxy hydrocarbon feeds, especially Fischer-Tropsch waxes or reaction products, all or at least a portion of which boils above 700° F., i.e., 700° F.+. The waxy feed is first contacted, with hydrogen, over a dual functional catalyst to produce hydroisomerization and hydrocracking reactions sufficient to convert at least about 20 percent to about 50 percent, preferably from about 20 percent to about 40 percent, on a once through basis based on the weight of the 700° F.+ feed, or 700° F.+ feed component, to 700° F.− materials, and produce 700° F.+ materials rich in methyl-paraffins. This resultant crude product, which contains both 700° F.− and 700° F.+ materials, characterized generally as a $C_5$-1050° F.+ crude fraction, is first topped via atmospheric distillation to produce a lower boiling fraction the upper end of which boils between about 650° F. and 750° F., e.g., 700° F., and a higher boiling, or bottoms fraction having an initial boiling point ranging between about 650° F. and 750° F., e.g., 700° F., and an upper end or final boiling point of about 1050° F.+, e.g., a 700° F.+ fraction. The lower boiling fraction, e.g., the 700° F.− fraction, from the distillation is a non-lube, or fuel fraction.

At these conversion levels, the hydroisomerization/hydrocracking reactions convert a significant amount of the waxy, or paraffinic feed to 700° F.+ methyl-paraffins, i.e., isoparaffins containing one or more methyl groups in the molecule, with minimal formation of branches of carbon number greater than 1; i.e., ethyl, propyl, butyl or the like. The 700° F.+ bottoms fractions so-treated contain 700° F.+ isoparaffins that have less than about 7.5 methyl branches per 100 carbon atoms or 6.0 to 7.5 methyl branches, preferably less than about 7.0 methyl branches or 6.0 to 7.0 methyl branches, more preferably from about 6.5 to about 7.0 methyl branches per 100 carbon atoms, in the molecule. These isoparaffins, contained in a mixture with other materials, provide a product from which high performance, highly biodegradable lube oils can be obtained. The degree of branching, particularly methyl branching, is indicative of the biodegradability of the oil. That is, higher degrees of branching are less biodegradable or not biodegradable at all, while lower degrees of branching, e.g., <7.8 methyls, are indicative of biodegradability.

The higher boiling bottoms fractions, e.g., the 700° F.+ bottoms fraction containing the methyl-paraffins, or crude fraction, is dewaxed in a conventional solvent dewaxing step to remove n-paraffins, and the recovered dewaxed product, or dewaxed oil, is fractionated under vacuum to produce paraffinic lubricating oil fractions of different viscosity grades, including hydrocarbon oil fractions suitable as high performance engine oils and engine lubricants which, unlike most hydrocarbon base oils, are biodegradable on release or escape into the environment. In terms of their performance they are unsurpassed by the PAO lubricants, and are superior thereto in terms of their biodegradability.

4. DETAILED DESCRIPTION

The feed materials that are isomerized to produce the lube base stocks, and lubricants with the catalyst of this invention are waxy feeds, i.e., $C_5$+, preferably having an initial boiling point above about 350° F. (117° C.), more preferably above about 550° F. (288° C.), and contain a major amount of components boiling above 700° F. (370° C.). The feed may be obtained either from a Fischer-Tropsch process which produces substantially normal paraffins, or from petroleum derived slack waxes.

Slack waxes are the by-products of dewaxing operations where a diluent such as propane or a ketone (e.g., methyl-ethyl ketone, methyl isobutyl ketone) or other diluent is employed to promote wax crystal growth, the wax being removed from the base oil by filtration or other suitable means. The slack waxes are generally paraffinic in nature, boil above about 600° F. (316° C.), preferably in the range of 600° F. (316° C.) to about 1050° F. (566° C.), and may contain from about 1 to about 35 wt. % oil. Waxes with low oil contents, e.g., 5–20 wt. % are preferred; however, waxy distillates or raffinates containing 5–45% wax may also be used as feeds. Slack waxes are usually freed of polynuclear aromatics and hetero-atom compounds by techniques known in the art; e.g., mild hydrotreating as described in U.S. Pat. No. 4,900,707, which also reduces sulfur and nitrogen levels preferably to less than 5 ppm and less than 2 ppm, respectively. Fischer-Tropsch waxes are preferred feed materials, having negligible amounts of aromatics, sulfur and nitrogen compounds. The Fischer-Tropsch liquid, or wax, is characterized as the product of a Fischer-Tropsch process wherein a synthetic gas, or mixture of hydrogen and carbon monoxide, is processed at elevated temperature over a supported catalyst comprised of a Group VIII metal, or metals, of the Periodic Table of The Elements (Sargent-Welch Scientific Company, Copyright 1968), e.g., cobalt, ruthenium, iron, etc. The Fischer-Tropsch wax contains $C_5$+, preferably $C_{10}$+, more preferably $C_{20}$+ paraffins. A distillation showing the fractional make up (±10 wt. % for each fraction) of a typical Fischer-Tropsch process liquid feedstock is as follows:

| Boiling Temperature Range | Wt. % of Fraction |
|---|---|
| IBP–320° F. | 13 |
| 320–500° F. | 23 |
| 500–700° F. | 19 |
| 700–1050° F. | 34 |
| 1050° F.+ | 11 |
| | 100 |

The wax feed is contacted, with hydrogen, at hydrocracking/hydroisomerization conditions over a bifunctional catalyst, or catalyst containing a metal, or metals, hydrogenation component and an acidic oxide support component active in producing both hydrocracking and hydroisomerization reactions. Preferably, a fixed bed of the catalyst is contacted with the feed at conditions which convert about 20 to 50 wt. %, preferably about 25 to 40 wt. %, of the 700° F. components of the feed to 700° F.– materials and produce a lower boiling fraction having an upper end boiling point between about 650° F. and 750° F., e.g., 700° F., and a higher boiling, or bottoms fraction having an initial boiling point between about 650° F. and 750° F., e.g., 700° F., the higher boiling fraction that remains containing high quality blending components for the production of high performance biodegradable base oils. In general, the hydrocracking/hydroisomerization reaction is conducted by contacting the waxy feed over the catalyst at a controlled combination of conditions which produce these levels of conversion; i.e., by selection of temperatures ranging from about 400° F. to about 850° F., preferably from about 500° F. to about 700° F., pressures ranging generally from about 100 pounds per square inch gauge (psig) to about 1500 psig, preferably from about 300 psig to about 1000 psig, hydrogen treat gas rates ranging from about 1000 SCFB to about 10,000 SCFB, preferably from about 2000 SCFB to about 5000 SCFB, and space velocities ranging generally from about 0.5 LHSV to about 10 LHSV, preferably from about 0.5 LHSV to about 2.0 LHSV.

The active metal component of the catalyst is preferably a Group VIII metal, or metals, essentially free of noble metal or metals, of the Periodic Table Of The Elements (Sargent-Welch Scientific Company Copyright 1968) in amount sufficient to be catalytically active for hydrocracking and hydroisomerization of the waxy feed. The catalyst preferably also contains, in addition to the Group VIII metal, or metals, a Group VIB metal, or metals, of the Periodic Table, and may also contain a Group IB metal or metals. Generally, metal concentrations range from about 0.01 percent to about 20 percent, based on the total weight of the catalyst (wt. %), preferably from about 0.5 wt. percent to about 20 wt. percent. Exemplary of such metals are such non-noble Group VIII metals as nickel and cobalt, or mixtures of these metals with each other or with other metals, such as copper, a Group IB metal, or molybdenum, a Group VIB metal. The metal, or metals, is incorporated with the support component of the catalyst by known methods, e.g., by impregnation of the support with a solution of a suitable salt or acid of the metal, or metals, drying and calcination. Preferred catalysts contain cobalt and molybdenum, and copper or nickel may also be present, but nickel seems to have little effect on the hydroisomerization.

The catalyst support is constituted of metal oxide, or metal oxides, components at least one component of which is an acidic oxide active in producing olefin cracking and hydroisomerization reactions. Exemplary oxides include silica, silica-alumina, clays, e.g., pillared clays, magnesia, titania, zirconia, halides, e.g., chlorided alumina, and the like. The catalyst support is preferably constituted of silica and alumina, a particularly preferred support being constituted of up to about 35 wt. % silica, preferably from about 2 wt. % to about 35 wt. % silica, and having the following pore-structural characteristics:

| Pore Radius, Å | Pore Volume |
|---|---|
| 0–300 | >0.03 ml/g |
| 100–75,000 | <0.35 ml/g |
| 0–30 | <25% of the volume of the pores with 0–300 Å radius |
| 100–300 | <40% of the volume of the pores with 0–300 Å radius |

The base silica and alumina materials can be, e.g., soluble silica containing compounds such as alkali metal silicates (preferably where $Na_2O:SiO_2$=1:2 to 1:4), tetraalkoxy silane, orthosilic acid ester, etc.; sulfates, nitrates, or chlorides of aluminum alkali metal aluminates; or inorganic or organic salts of alkoxides or the like. When precipitating the hydrates of silica or alumina from a solution of such starting materials, a suitable acid or base is added and the pH is set within a range of about 6.0 to 11.0. Precipitation and aging are carried out, with heating, by adding an acid or base under reflux to prevent evaporation of the treating liquid and change of pH. The remainder of the support producing process is the same as those commonly employed, including filtering, drying and calcination of the support material. The support may also contain small amounts, e.g., 1–30 wt. %, of materials such as magnesia, titania, zirconia, hafnia, or the like.

Support materials and their preparation are described more fully in U.S. Pat. No. 3,843,509 incorporated herein by reference. The support materials generally have a surface area ranging from about 180–400 $m^2/g$, preferably 230–375 $m^2/g$, a pore volume generally of about 0.3 to 1.0 ml/g, preferably about 0.5 to 0.95 ml/g, bulk density of generally about 0.5–1.0 g/ml, and a side crushing strength of about 0.8 to 3.5 kg/mm.

The hydrocracking/hydroisomerization reaction is conducted in one or a plurality of reactors connected in series, generally from about 1 to about 5 reactors; but preferably the reaction is conducted in a single reactor. The waxy hydrocarbon feed, e.g., Fischer-Tropsch wax, preferably one boiling above about 700° F., or has a large amount of 700° F.+ hydrocarbon components, is fed, with hydrogen, into the reactor, a first reactor of the series, to contact a fixed bed of the catalyst at hydrocracking/hydroisomerization reaction conditions to hydrocrack, hydroisomerize and convert at least a portion of the waxy feed to products which include after further work up high quality oils and lube blending components.

The following examples are illustrative of the more salient features of the invention. All parts, and percentages, are given in terms of weight unless otherwise specified.

EXAMPLES 1–9

A mixture of hydrogen and carbon monoxide synthesis gas ($H_2$:CO 2.11–2.16) was converted to heavy paraffins in a slurry Fischer-Tropsch reactor. A titania supported cobalt rhenium catalyst was utilized for the Fischer-Tropsch reaction. The reaction was conducted at 422–428° F., 287–289 psig, and the feed was introduced at a linear velocity of 12 to 17.5 cm/sec. The alpha of the Fischer-Tropsch synthesis step was 0.92. The paraffinic Fischer-Tropsch product was isolated in three nominally different boiling streams; separated by utilizing a rough flash. The three boiling fractions which were obtained were: 1) a $C_5$-500° F. boiling fraction, i.e., F-T cold separator liquids; 2) a 500–700° F. boiling fraction, i.e., F-T hot separator liquids; and 3) a 700° F.+ boiling fraction, i.e., a F-T reactor wax.

A series of base oils were prepared in runs made by hydrocracking and isomerizing the 700° F.+ Fischer-Tropsch reactor wax feedstock, with hydrogen, at different levels of conversion over a silica enhanced cobalt-molybdenum-nickel catalyst (CoO, 3.6 wt. %; $MoO_3$, 16.4 wt. %; NiO, 0.66 wt. %; on a $SiO_2$-$Al_2O_3$ support, 13.7 wt. % of which is silica); having a surface area of 270 $m^2$/g, and pore volume <30 mm equal to 0.43). A combination of reaction conditions, i.e., as relates to temperature, space velocity, pressure and hydrogen treat rate, to convert 30 wt. %, 35 wt. %, 45 wt. %, 50 wt. %, 58 wt. %, 67 wt. %, and 80 wt. % respectively, of the feedstock to materials boiling below 700° F., i.e., 700° F.−. The conditions for each of the respective runs and the yields which were obtained for each are given in Table 1. The Table also lists the amounts of IBP-650° F. and 650° F.+ products obtained by 15/5 distillation.

TABLE 1

| | Conversion to 700° F-, wt. % | | | | | | |
|---|---|---|---|---|---|---|---|
| | 30 | 35 | 45 | 50 | 58 | 67 | 80 |
| Operating Conditions | | | | | | | |
| Temperature, ° F. | 681.9 | 689 | 705.2 | 701.5 | 709.7 | 707.1 | 711.4 |
| Space Velocity, LHSV | 0.42 | 0.50 | 0.50 | 0.45 | 0.50 | 0.43 | 0.44 |
| Pressure, psig | — | — | 1000 | — | — | — | — |
| $H_2$ Treat Rate, SCF/B | — | — | 2500 | — | — | — | — |
| Yields (wt. % recovery) | | | | | | | |
| $C_1$—$C_4$ | 1.17 | 0.73 | 1.73 | 2.11 | 2.14 | 2.43 | 3.70 |
| $C_5$ - 320° F. | 5.48 | 3.11 | 9.68 | 9.75 | 9.48 | 14.93 | 23.10 |
| 320–550° F. | 10.43 | 10.11 | 17.82 | 17.92 | 22.87 | 25.20 | 27.04 |
| 550–700° F. | 20.48 | 23.94 | 21.88 | 24.63 | 27.81 | 28.01 | 30.21 |
| 700° F.+ | 62.44 | 62.11 | 48.89 | 45.59 | 37.70 | 29.43 | 15.93 |
| 15/5 Composite Distillation (wt. %) | | | | | | | |
| IBP-650° F. | 32.25 | 26.71 | 37.46 | 44.26 | 48.35 | 59.80 | 67.77 |
| 650° F.+ | 67.75 | 73.29 | 62.54 | 55.74 | 51.65 | 40.20 | 32.23 |

A 650° F.+ bottom fraction was recovered from the products obtained from each of the runs by atmospheric distillation, and then again fractionated under high vacuum to produce several viscosity grades of lubricant, viz. 60N, 100N, 175N and about 350–400N. The residual products were then subjected to solvent dewaxing to remove waxy hydrocarbons and lower the pour point to about −18° C. (32° F.).

For each viscosity grade, the dewaxing conditions were held constant so that the effect of conversion level on dewaxing could be evaluated. The dewaxing conditions for 100N and 175N viscosity grades at the 30%, 50% 67% and 80% conversion levels are given in Table 2.

TABLE 2

| Dewaxing Conditions[1] | Viscosity Grade | |
|---|---|---|
| | 100 N | 175 N |
| 30% Conversion | | |
| Solvent:Oil Ratio | 3:1 | 3:1 |
| Filter Temp, ° C. | −21 | −21 |
| Pour Pt,° C. | −18 | −18 |
| 50% Conversion | | |
| Solvent:Oil Ratio | 3:1 | 3:1 |
| Filter Temp, ° C. | −21 | −21 |
| Pour Pt, ° C. | −21 | −21 |
| 67% Conversion | | |
| Solvent:Oil Ratio | 3:1 | 3:1 |
| Filter Temp, ° C. | −21 | −21 |
| Pour Pt,° C. | −15 | −18 |
| 80% Conversion | | |
| Solvent:Oil Ratio | 3:1 | 3:1 |
| Filter Temp, ° C. | −21 | −21 |
| Pour Pt, ° C. | −24 | −24 |

[1]All dewaxings employed 100% methylisobutylketone, MIBK.

The physical properties, yields of dewaxed oil, DWO, and corresponding dry wax contents (both as wt. % on waxy feed) for each dewaxing in terms of the 100N and 175N viscosity grades at specific levels of conversion are given in Table 3.

TABLE 3

| | Dewaxed Base Oil Physical Properties Viscosity Grades | | | | | | | |
|---|---|---|---|---|---|---|---|---|
| | 30% Conversion | | 50% Conversion | | 67% Conversion | | 80% Conversion | |
| | 100 N | 175 N | 100 N | 175 N | 100 N | 175 N | 100 N | 175 N |
| Dewaxed Oil Yield/ Dry Wax Content (wt. % on waxy feed) | 80.7/17.6 | 75.3/21.4 | 93.0/6.6 | 91.1/7.7 | 97/2.4 | 92/5.2 | 98/2.0 96.3/1.7 | |
| Pour/Cloud Pt., ° C. | −18/−14 | −18/−14 | −21/−14 | −21/−17 | −15/−7 | −18/−14 | −24/−21 | −24/−21 |
| Density @ 15° C., kg/dm | 0.8143 | 0.8218 | 0.8153 | 0.8229 | 0.8147 | 0.8231 | 0.8160 | 0.8234 |
| Refractive Index @ 20° C. | | | | | | | | |
| Viscosity, cSt | | | | | | | | |
| @40° C. | 15.59 | 26.96 | 16.28 | 29.14 | 15.90 | 28.76 | 16.71 | 18.94 |
| @100° C. | 3.81 | 5.59 | 3.86 | 5.77 | 3.77 | 5.68 | 3.85 | 5.61 |
| Viscosity Index | 141 | 153 | 133 | 145 | 129 | 143 | 124 | 136 |
| GCD, ° C. | | | | | | | | |
| IBP | 346 | 380 | 343 | 390 | 347 | 394 | 351 | 393 |
| 5% | 369 | 408 | 367 | 418 | 369 | 419 | 370 | 416 |
| 50% | 426 | 471 | 424 | 473 | 421 | 469 | 421 | 466 |
| 95% | 486 | 535 | 488 | 531 | 479 | 524 | 478 | 523 |
| FBP | 522 | 567 | 528 | 565 | 515 | 558 | 513 | 559 |

Nuclear magnetic resonance (NMR) branching densities for 100N base oils produced at 30%, 50%, 67%, and 80% levels, respectively, are given in Table 4. It will be observed that the lower levels of methyl branching occurs at the lower conversion levels; with the biodegradability of the oil increasing at the lower levels of conversion. Compositions of highest biodegradability are thus produced at the 30 wt. % level of conversion, and the next highest biodegradability compositions are produced at the 50 wt. % conversion level.

TABLE 4

| 100 N Base Oil, $^{13}$CNMR Branching Densities | ------% Conversion------ Base Oil | | | |
|---|---|---|---|---|
| | 30 | 50 | 67 | 80 |
| V.I. | 141 | 133 | 129 | 124 |
| Per 100 Carbons | | | | |
| Methyl Groups ($CH_3^-$) | 6.8 | 7.5 | 7.5 | 7.8 |

It is also found that the viscosity index, VI, decreases with increasing level of conversion for each specific viscosity grade. This is because base oils prepared at higher conversion levels tend to be more highly branched and consequently have lower viscosity indexes. For the 100N base oils, the VI ranges from 141 to 118. For the 175N oils, the corresponding VI range is 153 to 136, respectively. The 175N base oils have VIs which are also comparable to the commercial ETHYLFLO 166 which has a VI of 143. The VI of the 100N viscosity grade is comparable to the commercial ETHYLFLO 164 which has a VI of 125. For purposes of comparison, certain physical properties of the commercial 100N ETHYLFLO 164 and 175N ETHYLFLO 166 are presented in Table 5.

TABLE 5

| ETHYLFLO ™ 164 (Lot 200-128) | |
|---|---|
| Viscosity at 100° C., cSt | 3.88 |
| Viscosity at 40° C., cSt | 16.9 |
| Viscosity at −40° C., cSt | 2450 |
| Viscosity Index | 125 |
| Pour Point, ° C. | −70 |
| Flash Point (D-92), ° C. | 217 |
| NOACK volatility, % | 11.7 |
| CEC-L-33-T-82 | 30% |
| **ETHYLFLO ™ 166 (Lot 200-122)** | |
| Viscosity at 100° C., cSt | 5.98 |
| Viscosity at 40° C., cSt | 30.9 |
| Viscosity at −40° C., cSt | 7830 |
| Pour Point, ° C. | −64 |
| Flash Point (D-92), ° C. | 235 |
| NOACK VOLATILITY, % | 6.1 |
| Viscosity Index | 143 |
| CEC-L-33-T-82 | 29% |

To determine the biodegradability of the DWO base stocks, and lubricant compositions, tests were conducted in accordance with CEC-L-33-T-82, a test method developed by the Coordinating European Council (CEC) and reported in "Biodegradability Of Two-Stroke Cycle Outboard Engine Oils In Water: Tentative Test Method" pp 1–8 and incorporated herein by reference. The test measures the decrease in the amount of a substrate due to microbial action. It has been shown, as measured by CEC-L-33-T-82 that the DWO base stocks, and lubricant compositions produced in accordance with this invention are of biodegradability above about 50%, and 10 are generally above about 50% to about 90%, and higher, biodegradable.

EXAMPLES 10–13

The CEC-L-33-T-82 test was run to observe the biodegradation of the following samples over a 21 day period, to wit:

Samples

A: Base Oil 100N, 30 wt. % Conv.—1.5133 g/100 mL FREON
B: Base Oil 100N, 50 wt. % Conv.—1.4314 g/100 mL FREON
C: Base Oil 100N, 67 wt. % Conv.—1.5090 g/100 mL FREON
D: Base Oil 100N, 80 wt. % Conv.—1.5388 g/100 mL FREON
X: VISTONE A30—1.4991 g/100 mL FREON Positive Calibration Material Each of the tests were conducted using a FREON solvent, and the stock solutions used were standard as required by the test procedure.

The inoculum used was non-filtered primary effluent from the Pike Brook Treatment Plant in Bellemead, N.J. The inoculum was determined to have between $1\times10^4$ and $1\times10^5$ colony forming units/mL (CFU/mL) by Easicult-TCC dip slides.

Triplicate test systems for all test materials and Vistone A30 were prepared and analyzed on day zero for parent material concentration. All extractions were performed as described in the test procedure. The analyses were performed on the Nicolet Model 205 FT-IR. Triplicate test systems for samples B through X, in addition to poisoned systems of each sample were placed on orbital shakers and continuously agitated at 150 rpm in total darkness at 25±0° C. until day twenty-one. On day twenty-one the samples were analyzed for residual parent material. Sample "A" was also evaluated at the day seven interval to determine removal rate along with the above mentioned samples. Triplicate systems for "A" were prepared, extracted and analyzed after seven, fourteen and twenty-one days of incubation.

RESULTS
100 N BASE OILS

| SAMPLE Level of Conversion | % BIODEGRADATION (21 DAYS) | STANDARD DEVIATION, SD |
|---|---|---|
| A: Base Oil 30 wt. % | 84.62 | 1.12 |
| B: Base Oil 50 wt. % | 77.95 | 0.86 |
| C: Base Oil 67 wt. % | 73.46 | 1.01 |
| D: Base Oil 80 wt. % | 73.18 | 2.34 |
| E. ETHYLFLO 164 | 30.00 | 0.54 |
| X: VISTONE A30 | 98.62 | 1.09 |

[1]Based on analysis of triplicate inoculated test systems and triplicate poisoned test systems.

RATE STUDY SAMPLE A

| DAY | % BIODEGRADATION | SD |
|---|---|---|
| 7 | 76.15 | 2.74 |
| 14 | 82.82 | 2.37 |
| 21 | 84.62 | 1.12 |

EXAMPLES 14–16

The CEC-L-33-T-82 test was run to observe the biodegradation of the following test materials over a 21 day period.

Samples

A:[1] Base Oil 175N, 30 wt. % Conv.—1.58 g/100 mL FREON
B:[2] Base Oil 175N, 50 wt. % Conv.—1.09 g/100 mL FREON
C:[1] Base Oil 175N, 80 wt. % Conv.—1.43 g/100 mL FREON
X:[1] VISTONE A30—1.5 g/100 mL FREON Positive Calibration Material

[1] 500 μL used to dose test systems to achieve ≈7.5 mg loading of test material.
[2] 750 μL used to dose test systems to achieve ≈7.5 mg loading of test material.

Each of the tests were conducted using a FREON solvent, and the stock solutions used were standard as required by the test procedure.

The inoculum was non-filtered primary effluent from the Pike Brook Treatment Plant in Bellemead, N.J. The inoculum was determined to have between $1\times10^4$ and $1\times10^5$ colony forming units/mL (CFU/mL) by Easicult-TCC dip slides.

Triplicate test systems for all test materials and Vistone A30 were prepared and analyzed on day zero for parent material concentration. All extractions were performed as described in the test procedure. The analyses were performed on the Nicolet Model 205 FT-IR. Triplicate test systems for samples A through X, in addition to poisoned systems of each sample were placed inside environmental chambers and continuously agitated at 150 rpm in total darkness at 25±0° C. until day twenty-one. On day twenty-one the samples were analyzed for residual parent material.

RESULTS
175 N BASE OILS

| SAMPLE | % BIODEGRADATION (21 DAYS)[1] | SD |
|---|---|---|
| A: Base Oil | 76.93 | 1.452 |
| B: Base Oil | 62.01 | 1.379 |
| C: Base Oil | 51.04 | 1.657 |
| G. ETHYLFLO 166 | 29.0 | |
| X: VISTONE A30 | 85.31 | 0.408 |

[1]Based on analysis of triplicate inoculated test systems and triplicate poisoned test systems.

These data show that two different 100N oils were of biodegradability approaching 75%, and two different 100N oils were of biodegradability well above 75%; one approximating 85%. The Blue Angels in Germany, defines "readily biodegradable" as >80% in the CEC-L-33-T-82 test. The three 175N oils that were demonstrated had biodegradability values ranging between about 51% to about 77%.

The DWO base stocks, and lubricant compositions due to their high paraffinic content, >97.5 Vol. %, are also suitable as feedstocks for medicinal grade white oils. The following is exemplary.

EXAMPLE 18

A dewaxed 60N base oil was subjected to mild hydrofining over a Ni—Mn—$MoSO_4$ bulk catalyst to produce an 80wt. % level of conversion (i.e., 240° C., 600 psi $H_2$, 0.25 LHSV). The product readily passed the diagnostic "hot acid test" for medicinal grade white oils.

Feed Preparation

Example A

A mixture of hydrogen and carbon monoxide synthesis gas ($H_2$/CO=2.0–2.2) was converted to heavy paraffins in a slurry Fischer-Tropsch reactor using a titania supported cobalt rhenium catalyst. The reaction was conducted at about 400–450° F., 280 psig, and the feed was introduced at a linear velocity of 12 to 17.5 cm/sec. The kinetic alpha of the Fischer-Tropsch product was 0.92. The Fischer-Tropsch wax feed was withdrawn directly from the slurry reactor. The boiling point distribution and oxygen content of this wax is given in Table 1.

TABLE 6

| Boiling Range | Wt. % |
|---|---|
| IBP–350° F. | 0.00 |
| 350–500° F. | 0.70 |
| 500–700° F. | 20.48 |
| 700° F.+ | 78.82 |
| Oxygen Content wt. % | 0.107 |

Example B

The Fischer-Tropsch wax from the above example was then mildly hydrotreated over a commercial massive nickel on alumina catalyst to reduce the level of oxygenates. This step is necessary for Pt/F-alumna hydroisomerization catalysts because oxygenates in the feed will be hydrogenated to water. The resulting water will react with the fluoride on the catalyst resulting in the fluoride being stripped off the catalyst causing catalyst activity to decrease. In addition, it is possible that the fluoride can be converted to HF, causing severe reactor corrosion. Note that this is not a concern for the HI catalyst of the present invention. Also, the cost of Pt/F-Alumina catalyst is about 10 times the cost of the catalyst of the present invention. The conditions for the hydrotreating reaction are given in Table 7 while the boiling point distribution and oxygen content of product wax is given in Table 8.

TABLE 7

| | |
|---|---|
| Temperature, ° F. (° C.) | 400 (204) |
| $H_2$ Pressure, psig (pure) | 750 |
| $H_2$ Treat Gas Rate, SCF/B | 2500 |
| LHSV, v/v/h | 1.0 |

TABLE 8

| Boiling Range | Wt. % |
|---|---|
| IBP–350° F. | 0.00 |
| 350–500° F. | 0.23 |
| 500–700° F. | 19.58 |
| 700° F.+ | 80.19 |
| Oxygen Content wt % | 0.004 |

Example C

The hydrotreated Fischer-Tropsch wax feed described in Example B was then used in hydroisomerization experiments utilizing a prototype Pt/F-alumina catalyst. A description of the catalyst and the start-up procedure is given in Table 9.

TABLE 9

| | |
|---|---|
| Catalyst: | 0.6 wt. Pt/5.5 wt. F/alumina |
| Surface Area: | 187 $m^2$/gram |
| Pore Volume: | 0.473 cc/g |
| Particle Size: | 1/16" |
| Catalyst Charge: | 10 cc |
| Reactor Mode: | Up-flow |

Catalyst was heated under $H_2$ at 750 psig to 700° F. at about 2° F./minute. Temperature was held at 700° F. for about 8 hours. The temperature was then lowered to the desired operating temperature and feed was introduced into the reactor. The temperature was adjusted to produce 700° F.+ conversion levels of about 30 and 50%. The conditions and yields for the respective runs are given in Table 10.

TABLE 10

| | | |
|---|---|---|
| Temperature, ° F. | 650 | 670 |
| Space Velocity, LHSV | 0.5 | 0.5 |
| Pressure, psig | 750 | 750 |
| $H_2$ Treat Rate, SCF/B | 2500 | 2500 |
| 700° F.+ Conv., % | 33.14 | 47.25 |
| Yields, wt. % | | |
| $C_1$–$C_4$ | 0.94 | 2.13 |
| $C_5$–320° F. | 5.88 | 11.31 |
| 320–550° F. | 14.48 | 16.92 |
| 550–700° F. | 25.09 | 27.34 |
| 700° F.+ | 53.61 | 42.30 |

The Pt/F-alumina catalyst is less effective in reducing the total liquid product (TLP) pour point than the catalyst of the current invention. It is likely that TLP pour point is determined by both the amount and type of wax present. Differential Scanning Calorimetry (DSC) was used to determine the 700° F.+ waxes at the 30% 700° F.+ conversion level. The data is given in Table 11. The DSC data show that the Pt/F-alumina catalyst produces a significantly more high melting wax relative to the catalyst of this invention.

TABLE 11

| Catalyst | Catalyst of Current Invention | Pt/F-Alumina |
|---|---|---|
| 700° F+ Conv. | 30 | 33 |
| Melting Range, ° C. | Wt. % Wax in Sample | |
| −90 to −20 | 5.66 | 2.81 |
| −20 to 0 | 14.47 | 9.10 |
| 0 to 20 | 30.27 | 24.01 |
| 20 to 40 | 33.13 | 30.04 |
| 40 to 60 | 16.32 | 28.36 |
| 60 to 80 | 0.13 | 5.71 |

The 700° F.+ bottom fraction (i.e., the lubricant fraction) was obtained for both runs using standard 15/5 atmospheric distillation. The bottoms were then fractionated again under high vacuum to produce different viscosity grades of lubricants, viz. 100N and 175N. The 100N and 175N waxy products were then subjected to solvent dewaxing to lower the pour point to about −18° C. For each viscosity grade the dewaxing conditions were held constant so that the effect of conversion level on dewaxing could be evaluated.

Nuclear magnetic resonance (NMR) branching density for the base oils were then measured and are reported in Table 12 along with the other pertinent lubricant properties. Clearly, the branching density is much higher for the Pt/F-alumina compared to the catalyst of this invention, and is indicative of lesser or no biodegradability.

TABLE 12

| | 33% Conversion | | 47% Conversion | |
|---|---|---|---|---|
| | 100 N | 175 N | 100 N | 175 N |
| Pour Point, ° C. | −18 | −18 | −20 | −19 |
| Viscosity, cSt | | | | |
| @ 40° C. | 15.70 | 27.80 | 16.35 | 28.75 |
| @ 100° C. | 3.80 | 5.62 | 3.85 | 5.66 |
| Viscosity Index | 137 | 147 | 131 | 141 |
| GCD, ° C. | | | | |
| IBP | 345 | 385 | 350 | 393 |
| 5% | 368 | 413 | 369 | 417 |
| 50% | 425 | 472 | 421 | 467 |
| 95% | 487 | 532 | 479 | 524 |
| FBP | 525 | 566 | 514 | 558 |
| $^{13}$CNMR Branching Density Methyls per 100 Carbon Atoms (—$CH_3$) | 7.9 | N/A | 8.4 | N/A |

This data indicates that the catalyst of this invention is better able to isomerize n-paraffins to give slightly branched paraffins than Pt/F-alumina; while Pt/F-alumina is better able to isomerize slightly and highly branched paraffins than is the catalyst of this invention. These findings reflect a fundamental difference in the mechanism of the hydroisomerization with the two catalysts.

We claim:

1. A biodegradable hydrocarbon lubricant base oil, wherein isoparaffins contained in said hydrocarbon lubricant base oil have methyl branches in an amount less than about 7.5 methyl branches per 100 carbons in the isoparaffin molecules, produced by a process comprising contacting a 700° F.+ Fischer-Tropsch feed with hydrogen over a bifunctional non-noble Group VIII metal catalyst to produce hydroisomerization and hydrocracking reaction at 700° F.+ conversion levels ranging from about 20 to about 50 percent on a once through basis, based on the weight of 700° F.+ feed converted to 700° F.− materials to produce a $C_5$-1050° F.+ crude fraction, recovering from the $C_5$-1050° F.+ fraction a residual fraction having an initial boiling point ranging from about 650° F. to about 750° F., dewaxing the residual fraction and recovering a dewaxed oil thereby producing a biodegradable hydrocarbon base oil.

2. The base oil of claim 1 wherein the Group VIII metal catalyst is selected from the group consisting of nickel, cobalt, and a mixture thereof.

3. The base oil of claim 2 wherein the metal catalyst further comprises a Group VI B metal.

4. The base oil of claim 3 wherein the metal catalyst further comprises a Group I B metal.

5. The base oil of claim 4, wherein said Group I B metal comprises copper and said Group VI B metal comprises molybdenum.

* * * * *